United States Patent [19]

Kerst

[11] Patent Number: 4,577,156

[45] Date of Patent: Mar. 18, 1986

[54] PUSH-PULL BETATRON PAIR

[75] Inventor: Donald W. Kerst, Madison, Wis.

[73] Assignee: The United States of America as represented by the United States Department of Energy, Washington, D.C.

[21] Appl. No.: 582,420

[22] Filed: Feb. 22, 1984

[51] Int. Cl.[4] ..... H05H 7/08

[52] U.S. Cl. ..... 328/237

[58] Field of Search ..... 328/237; 313/62, 359, 313/154

[56] References Cited

U.S. PATENT DOCUMENTS

| | | | |
|---|---|---|---|
| 2,697,167 | 12/1954 | Kerst | 328/237 |
| 2,698,384 | 12/1954 | Wideröe | 328/237 |
| 2,797,322 | 6/1957 | Von Arx | 328/237 |
| 2,819,393 | 1/1958 | Wideröe | 328/237 |

FOREIGN PATENT DOCUMENTS

| | | | |
|---|---|---|---|
| 931946 | 3/1948 | France | 313/62 |

OTHER PUBLICATIONS

"The Betatron", D. W. Kerst; *Handbuch der Physik* B2 XLIV 1956, pp. 193–217.

Chapter 7, "The Betatron–Magnetic Induction Accelerator", M. S. Livingston and J. P. Blewett, *Particle Accelerators* 1962; pp. 193–235.

*Primary Examiner*—Palmer C. DeMeo

*Assistant Examiner*—Sandra L. O'Shea

*Attorney, Agent, or Firm*—Clifton E. Clouse, Jr.; Roger S. Gaither; Judson R. Hightower

[57] ABSTRACT

A push-pull betatron accelerator with two coaxial betatron tubes in which two electron beams are alternately accelerated in opposite directions of rotation. Both tubes are linked by the same alternating current accelerating flux produced by one or more accelerating flux coils. The betatron tubes are provided with guide fields having alternating current components which are in the same direction and having direct current biasing components which are in opposite directions. One electron beam is accelerated when the accelerating flux is changing between its negative maximum and its positive maximum, while the other beam is accelerated when the accelerating flux is changing between its positive maximum and its negative maximum. In another embodiment, there is only one betatron tube, in which two electron beams are alternately accelerated in opposite directions of rotation; and in still another embodiment, there are two tubes in which electrons are accelerated alternately, but the AC components for the guide fields are in opposite directions for the two tubes, while the DC biasing components are polarized the same for both tubes.

6 Claims, 9 Drawing Figures

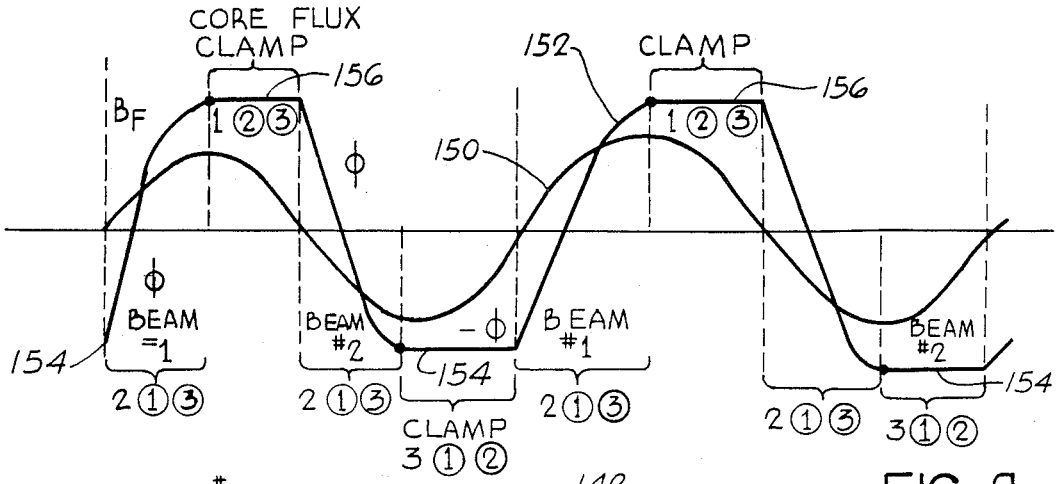
FIG. 9
① MEANS SWITCH #1 OPEN
1 MEANS SWITCH #1 SHUT
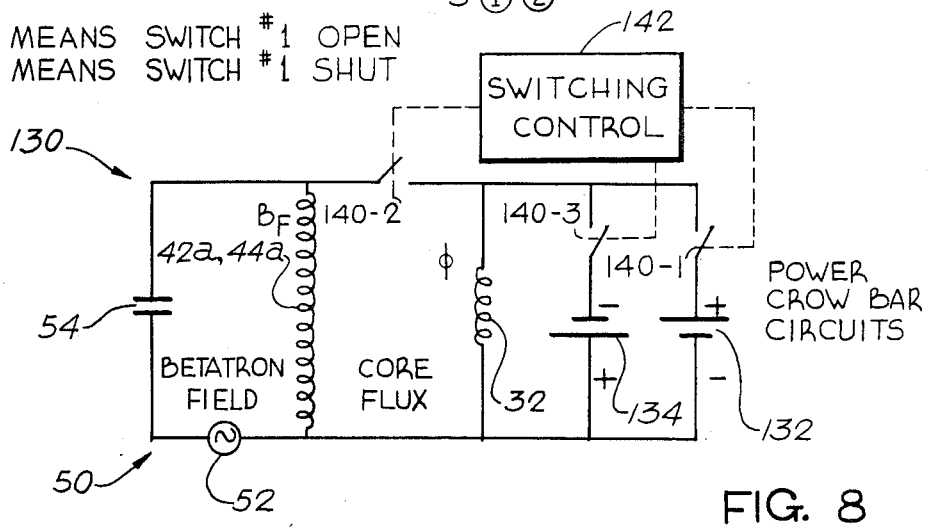
FIG. 8
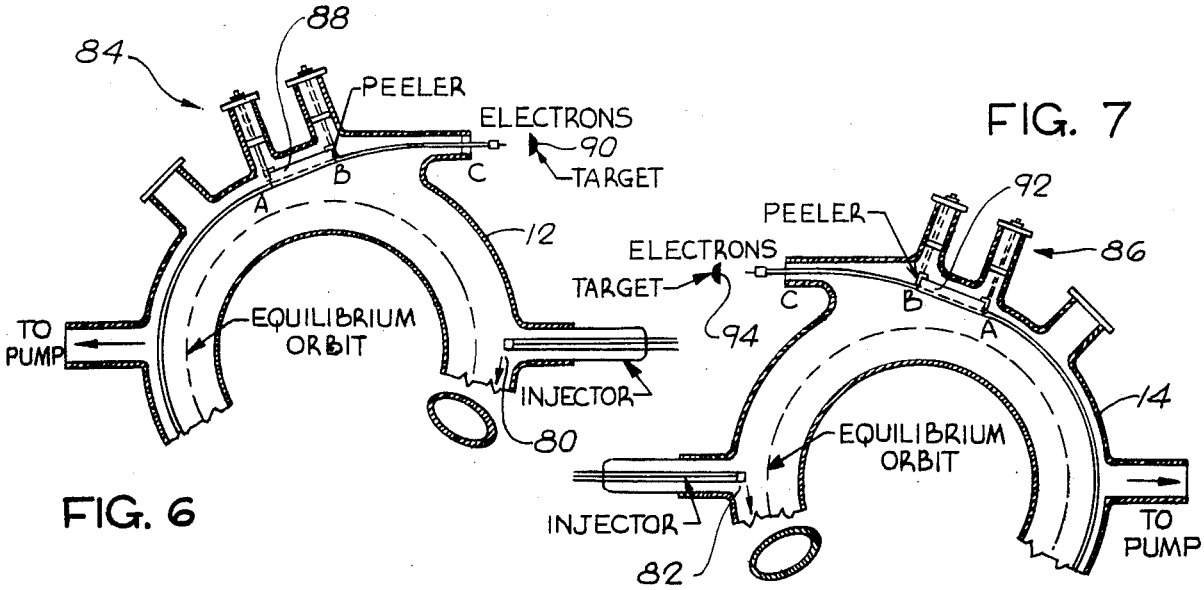
FIG. 7
FIG. 6

PUSH-PULL BETATRON PAIR

The United States Government has rights in this invention pursuant to Contract No. DE-ACO3-76SF00098 between the United States Department of Energy and the University of California.

FIELD OF THE INVENTION

This invention relates generally to betatron accelerators of the type in which electrons or other charged particles are accelerated to high energies as they travel in generally circular orbits around an annular accelerating tube. In a betatron accelerator, the charged particles are accelerated by a changing magnetic flux which links with the accelerating tube. The charged particles are guided along circular paths by a magnetic guide field through the accelerating tube. Such guide field changes in the proper relationship with the accelerating flux. Generally, both the accelerating flux and the guide field are produced by coils energized by alternating current. In some cases, direct current coils may be employed to bias the guide field or the accelerating flux, or both.

BACKGROUND OF THE INVENTION

The betatron is a charged particle accelerator which uses for its accelerating mechanism the electric field produced by a changing magnetic flux, linking the orbits of the electrons or other charged particles. The changing accelerating flux is generally produced by a coil or coils, energized with alternating current. The electrons or other charged particles are constrained to follow a generally circular orbit by the magnetic guide field at the orbit. Such guide field provides the centrally directed force which produces the circular motion. The guide field increases with increasing electron energy so that the successive orbits are of essentially constant radius. The magnetic guide field is also generally an alternating current field.

The changing magnetic field, linking with the orbits, serves to accelerate the electrons in the orbital beam. Simultaneously, the magnetic guide field at the orbit changes so as to maintain a constant radius while the energy of the orbiting electrons is increasing. While the flux linking with the orbits is increasing, an electromotive force is developed around the orbital path so that a tangential force is applied to the electrons or other charged particles, thus accelerating them to high energy. One may think of an ordinary transformer as operating in much the same manner, with the orbiting electrons replacing the secondary winding, except that the electrons in the secondary winding suffer so many atomic collisions that they acquire only a slow average velocity.

This constant radius characteristic of betatron accelerators is a consequence of the 2-to-1 rule which states that the rate of change of the space-averaged flux density in the central iron core within the orbit must equal twice the rate of change of the guide field at the orbit. Both fields must increase proportionately with time, the central field to produce the acceleration, and the guide field at the orbit to retain the particles of increasing energy in an orbit of constant radius.

A betatron accelerator employs means for injecting electrons or other charged particles into the accelerating tube, with a timing and an energy to produce acceleration of the electrons in substantially circular orbits around the accelerating tube. The electrons may be injected by an electron gun, comprising a hot filament and a grid, mounted close to the wall of the accelerating tube. The grid is at a positive potential to inject the electrons with a suitable initial velocity. Injection occurs when the guide field is slightly above zero, at a value consistent with the injection energy.

The alternating current guide field may be biased by a superimposed direct current field, to keep the guide field positive throughout all or most of the alternating current guide field. With the biased guide field, acceleration takes place during a greater portion of the alternating current cycle, approaching a half cycle of the alternating current which drives the magnet. The final energy is reached at the peak of the field, at which time the orbiting electrons are extracted so that they strike a target.

Betatrons are usually operated at 50, 60 or 180 cycles per second and are often resonated with a large capacitance. The entire magnet structure is usually made of laminated iron sheets to minimize eddy currents. The accelerating tube is in the form of an annular vacuum tube or chamber which surrounds the central core. In many cases, the central core has an air gap, which serves the function of controlling the reluctance of this part of the magnetic circuit so that the 2-to-1 rule will be observed. The vacuum tube may be made of glass, quartz or ceramic and may be lightly silvered or otherwise metalized on the inside surface, to prevent the accumulation of static charges from misdirected electrons. Such static charges would tend to interfere with the maintenance of circular orbits.

As the final energy of the orbiting electrons is approached, the orbits are expanded or contracted by various means, so that the electrons strike a target on the outer or inner wall. For example, the orbits may be expanded or contracted by altering the flux in the central core. The change in flux may be accomplished by placing in the core's air gap one or more pieces of magnetic material which saturate at the desired flux density. Another method of extracting the electrons is to pulse currents through special windings at the proper moment. In this way, the electron beam, which is of small cross section, is swept onto the target at a rate depending on the abruptness of the flux perturbation.

The final energy of the accelerated electrons can be approximately doubled, for a betatron of any particular radius, by utilizing biasing techniques. One such technique produces a field-biased betatron, in which a steady positive biasing field at the orbit is superimposed upon the usual alternating guide field, so that the net guide field changes from zero, or slightly more, to its positive peak value during a half cycle, while the purely alternating accelerating flux in the core changes from its negative peak to its positive peak. An alternative biasing technique is called flux-biasing, which is a pulsed technique in which the central core is given a permanent negative bias and is pulsed to an approximately equally large positive value during the time in which the guide field is driven from zero to its peak. It is also possible to employ a combination of flux-biasing and field-biasing.

A number of circuits have been devised, following these general lines, with auxiliary windings around various portions of the magnetic yoke and poles of the betatron accelerator. In some instances, the air gap in the core is eliminated so that the stored energy is reduced, while also reducing the cost and complexity of the power supply. In these cases, some other method of maintaining the 2-to-1 ratio is needed, such as the use of auxiliary guide field coils. In general, the use of biasing techniques reduces the weight of the iron magnetic circuit for a given energy.

In the conventional betatron accelerator, there is a single annular accelerating tube, in which electrons or other charged particles are accelerated around orbits in one direction of rotation, during the portion of the alternating current cycle in which the accelerating flux is changing in one direction, as between its negative peak and its positive peak. A full wave betatron has also been proposed, in which a second electron beam is injected into the betatron tube in the opposite direction of rotation, during the remainder of the alternating current cycle, when the flux is returning from its positive peak to its negative peak. However, the full wave betatron does not utilize the advantage of direct current field biasing. The present invention deals with the problem of providing a betatron utilizing two electron beams, while also obtaining the advantage of providing direct current biasing.

SUMMARY OF THE INVENTION

One object of the present invention is to provide a new and improved betatron accelerator, in which two different beams of electrons or other charged particles are accelerated in opposite directions of rotation during each complete cycle of the alternating current accelerating flux, while also obtaining the advantages of direct current biasing. The first electron beam is accelerated when the flux is changing between its negative peak and its positive peak. The second electron beam is accelerated when the flux is changing between its positive peak and its negative peak.

This and other objects of the present invention may be accomplished by providing a push-pull betatron accelerator, comprising first and second substantially coaxial spaced parallel annular accelerator tubes having vacuum chambers therein in which electrons or other charged particles are to be accelerated, a magnetic circuit including an axial magnetic core along the common axis of the tubes, accelerating flux producing means for producing an alternating current accelerating flux in the core and linking with the tubes for producing acceleration of charged particles in the tubes, guide field producing means for producing a guide field through both of the tubes for guiding the charged particles along generally circular orbits in the tubes, first and second injecting means for injecting charged particles into the respective first and second tubes in opposite directions of rotation and when the accelerating flux is changing in opposite directions, and target means for extracting and receiving the charged particles accelerated in the first and second tubes.

Preferably, the accelerator includes alternating current guide field producing means for producing an alternating current guide field through both tubes in the same direction, and direct current biasing field producing means for producing direct current biasing fields through the respective first and second tubes in opposite directions for summation in opposite directions with the alternating current guide field.

The accelerating flux may be produced by one or more coils on the central core or elsewhere in the magnetic circuit. The accelerating flux coils may be energized with alternating current by alternating current source means, which may include an alternating current source with one or more resonating capacitors.

The guide field may be produced by first and second guide field coils adjacent such first and second accelerator tubes. Such guide field coils may be energized with alternating current in phase with the energization of the accelerating flux coils. The alternating current guide field produced by such guide field coils is in the same direction through both accelerator tubes.

The direct current bias may be produced by first and second direct current bias field coils, energized from a direct current source, with opposite polarization, for producing direct current biasing fields through the respective first and second accelerator tubes in opposite directions for summation in opposite directions with the alternating current guide field. In this way, the biasing action for the first accelerator tube may be correct for accelerating electrons in one direction of rotation when the accelerating flux is changing between its negative peak and its positive peak. The biasing action for the second accelerator tube may be correct for accelerating electrons in the opposite direction of rotation when the accelerating flux is changing between its positive peak and its negative peak.

The direct current bias may also be produced by introducing direct current along with the alternating current into the first and second field coils for the two betatron tubes. The coils are energized with alternating current of the same phase, so that the alternating current component of the guide field is in the same direction through both betatron tubes. The direct current components are polarized oppositely, so that the direct current biases for the two betatron tubes are in opposite directions.

This may be accomplished by connecting the first and second field coils in series as to direct current, while connecting them in parallel as to alternating current. The direct current source may be connected into a series circuit which includes the first and second field coils. A conductor is connected between one end of each of the coils, while the direct current source is connected between the opposite ends of the coils. The alternating current source means may include an alternating current source or generator and first and second resonating capacitors. One terminal of the alternating current source may be connected to such conductor. The capacitors may be connected between the other terminal of the alternating current source and the opposite ends of the field coils. This arrangement has the advantage of automatically isolating the direct current from the alternating current source, while also isolating the alternating current from the direct current source. The capacitors prevent any flow of direct current through the alternating current source. Moreover, there is no flow of alternating current through the direct current source, because the alternating current voltages at both ends of the direct current source are the same and are in phase.

With this arrangement, the central flux coils may be energized with alternating current by means of additional coils which are inductively coupled with the field coils. In this way, the direct current does not flow through the accelerating flux coils.

This invention also provides an alternative betatron accelerator construction utilizing only one annular betatron tube, in which two betatron beams are alternately accelerated in opposite directions during different portions of the cycle. In this alternative construction, the accelerating flux coil or coils are pulsed sequentially with alternating current and direct current of alternate polarities, so that the accelerating flux is changed rapidly between its negative and positive maximum values and is clamped by direct current at its positive and negative values. The first electron beam is accelerated in one direction of rotation during approximately the first ninety degrees of the cycle, during which the accelerating flux is changed rapidly between its negative maximum and its positive maximum values. During approximately the next ninety degrees of the cycle, the accelerating flux is clamped by direct current at its positive maximum value. The second beam is accelerated during the third ninety degree interval of the cycle, during which the accelerating flux is changed rapidly between its positive maximum value and its negative maximum value. During the final ninety degree segment of the cycle, the accelerating flux is clamped at its negative maximum value by direct current. This alternative construction requires fast acting switching devices having high current handling capabilities. However, only one betatron tube is required for accelerating both electron beams.

BRIEF DESCRIPTION OF THE DRAWINGS

Further objects, advantages and features of the present invention will appear from the following description, taken with the accompanying drawings, in which:

FIGS. 6 and 7 are fragmentary cross sections taken through the two betatron tubes, generally along the lines 6—6 and 7—7 in FIG. 1.

FIG. 8 is a schematic circuit diagram illustrating another modified betatron accelerator.

FIG. 9 is a waveform diagram illustrating the method of operation of the betatron accelerator of FIG. 8.

DETAILED DESCRIPTION OF ILLUSTRATIVE EMBODIMENTS

Figure 1:
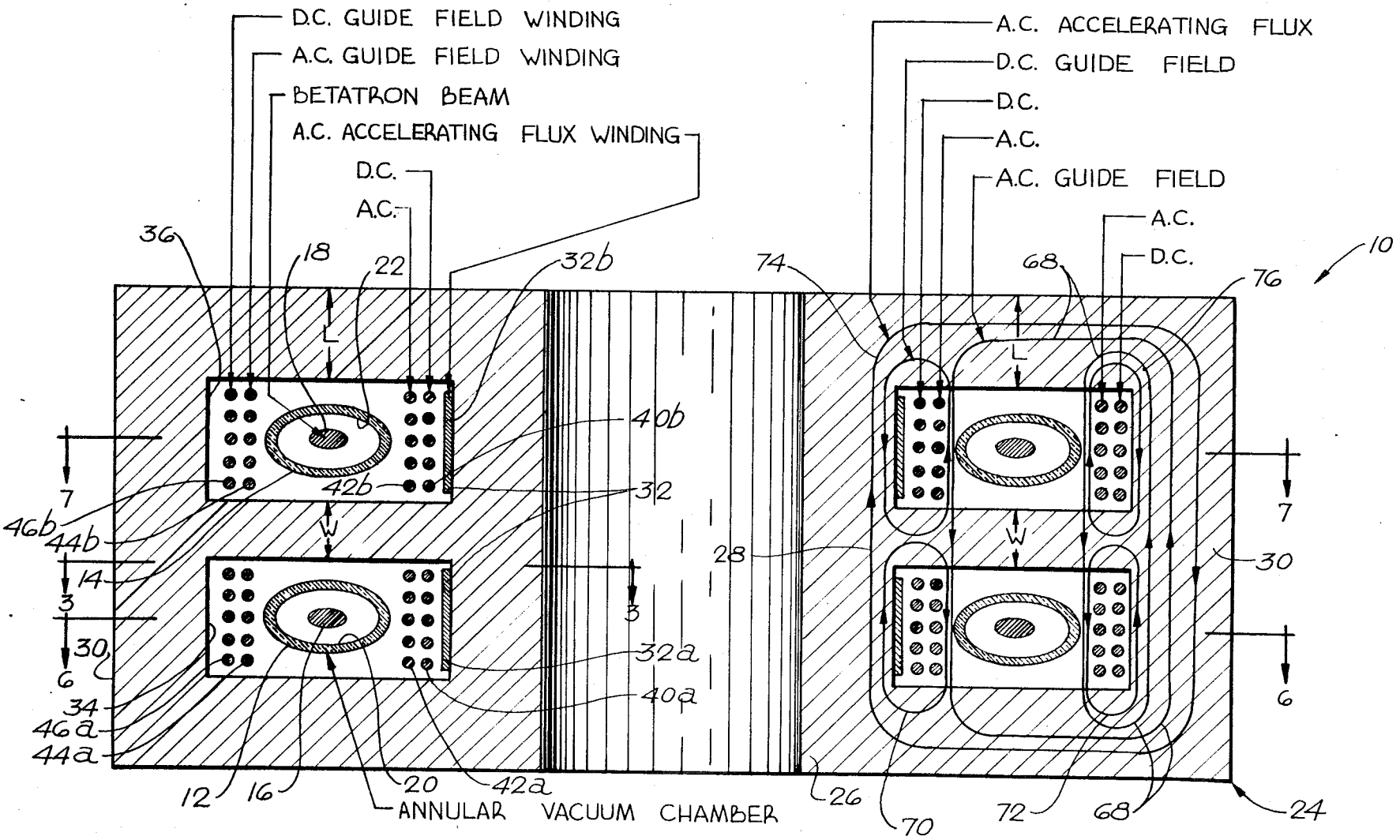
FIG. 1 is a diagrammatic central longitudinal section taken through a betatron accelerator to be described as an illustrative embodiment of the present invention.

As just indicated, FIG. 1 illustrates a push-pull betatron accelerator 10 to be described as an illustrative embodiment of the present invention. Unlike conventional betatron accelerators, the accelerator 10 comprises a pair of substantially parallel, annular, coaxial accelerator tubes 12 and 14 in which first and second beams 16 and 18 of electrons or other charged particles are accelerated. The tubes 12 and 14 provide annular vacuum chambers 20 and 22 therein, which are evacuated to a high vacuum. The tubes 12 and 14 are generally doughnut-shaped and are shown as being generally oval in cross section.

The betatron tubes 12 and 14 are served by a common magnetic circuit or yoke 24, which is preferably made of stacked laminations or sheets of iron or other magnetic material, similar to the laminations employed in transformers. The laminations minimize eddy current losses in the magnetic yoke 24.

The magnetic yoke 24 comprises a portion 26 which serves as a central or axial core, extending axially through both of the betatron tubes 12 and 14. In this case, the core 26 is hollow, but it could be solid, without any central opening.

The accelerator 10 comprises means for producing a rapidly changing accelerating magnetic flux having flux lines 28 extending longitudinally through the core 26 and linking with both betatron tubes 12 and 14 and both electron beams 16 and 18 therein. The accelerating flux lines 28 have return paths through outer return portions 30 of the magnetic yoke 24. The rapidly changing accelerating flux induces a circular electric field which accelerates the electrons in the betatron beams 16 and 18. The accelerating flux is produced by one or more accelerating flux coils or windings, around the central core 26 or elsewhere around one or more portions of the magnetic yoke 24. In this case, there are first and second accelerating flux windings or coils, designated collectively as 32 and individually as 32*a* and 32*b*. The flux windings 32 are located in first and second annular slots 34 and 36, formed in the magnetic yoke 24, for receiving the first and second betatron tubes 12 and 14. Each of the flux coils or windings 32*a* and 32*b* is shown as a single turn of a flat conductor, which may be made of sheet copper or the like, suitably insulated. The windings 32*a* and 32*b* may be supplied with alternating current and may be connected in series or in parallel or in various other circuit arrangements, as will be described in greater detail presently.

The accelerator 10 also comprises means for producing magnetic guide fields for electron beams 16 and 18 in both betatron tubes 12 and 14. The guide fields constrain the electrons or other charged particles to travel in substantially circular orbits in the tubes 12 and 14. The guide fields change in suitable relationships with the changing accelerating flux so that substantially circular electron orbits are maintained as the electrons are accelerated to progressively higher energies. In this case, the guide fields are produced by alternating current and are biased by direct currents, so that the guide fields have both alternating and direct components.

As shown in FIG. 1, the guide fields for the first and second betatron tubes 12 and 14 are produced by first and second sets of guide field producing coils or windings, disposed adjacent the first and second tubes 12 and 14, in the first and second annular slots 34 and 36. Thus, as shown in FIG. 1, the first betatron tube 12 has a first set of four guide field coils 40*a*, 42*a*, 44*a* and 46*a*, while the second betatron tube has a second set of four guide field coils 40*b*, 42*b*, 44*b* and 46*b*. As shown in FIG. 1, each of the guide field coils may have five turns around the central core 26, but any suitable number of turns may be employed. The turns are preferably made of stranded copper or other conductors to minimize eddy current losses.

As shown in FIG. 1, the coils 40*a* and 42*a* are between the betatron tube 12 and the central core 26, with the coil 40*a* closer to the core. The coils 44*a* and 46*a* are outside the periphery of the betatron tube 12. Similarly, the coils 40*b* and 42*b* are between the betatron tube 14 and the central core 26, with the coil 40*b* closer to the core. The coils 44*b* and 46*b* are outside the periphery of the ring-shaped tube 14. However, various other coil arrangements may be employed.

The guide field coils 40*a*–46*a* and 40*b*–46*b* produce guide flux lines across the slots 34 and 36 and through the betatron tubes 12 and 14, so as to constrain the electron beams 16 and 18 to travel along substantially circular orbits.

Figure 2:
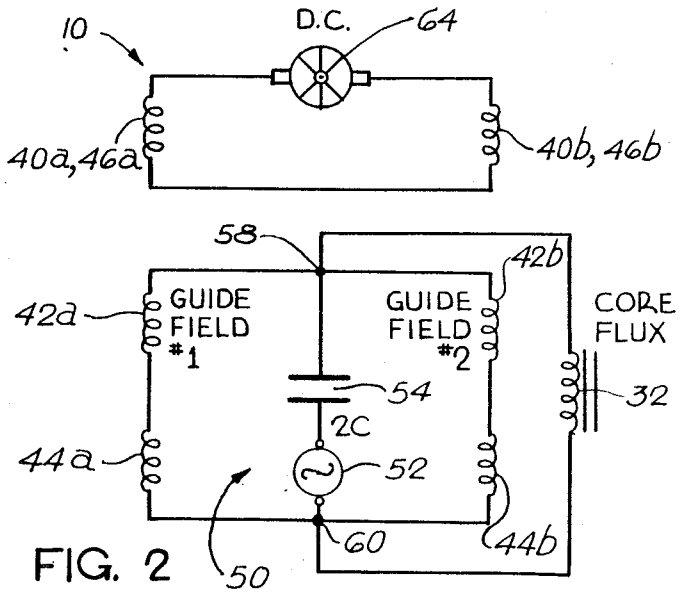
FIG. 2 is a schematic circuit diagram for the betatron accelerator of FIG. 1.

FIG. 2 comprises a schematic circuit diagram showing how the various coils employed in the betatron 10 of FIG. 1 may be energized with alternating and direct current. FIG. 2 includes alternating current source means 50 which may comprise an alternating current generator or source 52 in series with a resonating capacitance 54, which is shown as a single capacitor but actually comprises a bank of capacitors. The capacitance 54 establishes resonance with the inductance afforded by the various flux and field coils, so that increased alternating currents and voltages are produced in the coils. The alternating current generator needs to supply only enough power to take care of the resistance and other losses in the coils and the capacitance 56.

In FIG. 2, the series combination of the alternating current source 52 and the capacitance 54 is connected to energization terminals 58 and 60, across which the accelerating flux coils 32 are connected. Some of the guide field coils for both betatron tubes 12 and 14 are also connected to the energization terminals 58 and 60, so that these guide field coils are energized with alternating current which is substantially in phase with the alternating current energization of the accelerating flux coils 32. As shown, the guide field coils 42*a* and 44*a* for the first betatron tube 12 are connected in series across the energization terminals 58 and 60. The guide field coils 42*b* and 44*b* for the second betatron tube 14 are connected in series across the energization terminals 58 and 60. All of the coils 42*a*, 44*a*, 42*b* and 44*b* are phased the same, so that the alternating current component of the guiding and focusing field is in the same direction and has the same phase across both of the betatron tubes 12 and 14.

The circuit of FIG. 2 also includes a direct current source 64 which is connected in series with the guide field coils 40*a* and 46*a* for the first betatron tube 12 and the guide field coils 40*b* and 46*b* for the second betatron tube 14. The coils 40*b* and 46*b* are polarized oppositely from the coils 40*a* and 46*a*, so that the direct current components of the guide field are in opposite directions through the first and second betatron tubes 12 and 14. Thus, the guide fields for the first and second betatron tubes 12 and 14 are biased oppositely by the direct current.

In FIG. 1, the alternating current components of the guiding and focusing field are represented by flux lines 68. It will be seen that all of these flux lines extend in the same direction through the betatron tubes 12 and 14. The direct current biasing components of the guide field are represented by flux lines 70 and 72 for the first betatron tube 12, and by flux lines 74 and 76 for the second betatron tube 14. It will be seen that the D.C. flux lines 70 and 72 extend downwardly through the first betatron tube 12, while the flux lines 74 and 76 extend upwardly through the second betatron tube 14. Thus, the direct current biasing components are in opposite directions through the two betatron tubes 12 and 14.

FIGS. 6 and 7 are diagrammatic cross sectional views of the first and second betatron tubes 12 and 14, which comprise respective injectors 80 and 82 for injecting beams of electrons or other charged particles in opposite directions of rotation into the betatron tubes 12 and 14. The electrons are generally injected at relatively low energy, when the guide field is correspondingly small.

The first and second betatron tubes 12 and 14 also include respective target means 84 and 86 for extracting and receiving the electron beams when they have been accelerated to the maximum energy level. The target means 84 may include a peeler or extractor 88 and a target 90. The extractor 88 may include a magnetic coil which is pulsed with an energizing electrical current at the proper time, to peel or divert the high energy electron beam out of its circular orbit so that it strikes the target 90. Any other known or suitable extracting device may be employed. Similarly, the target means 86 may include an extractor 92 and a target 94.

Figure 3:
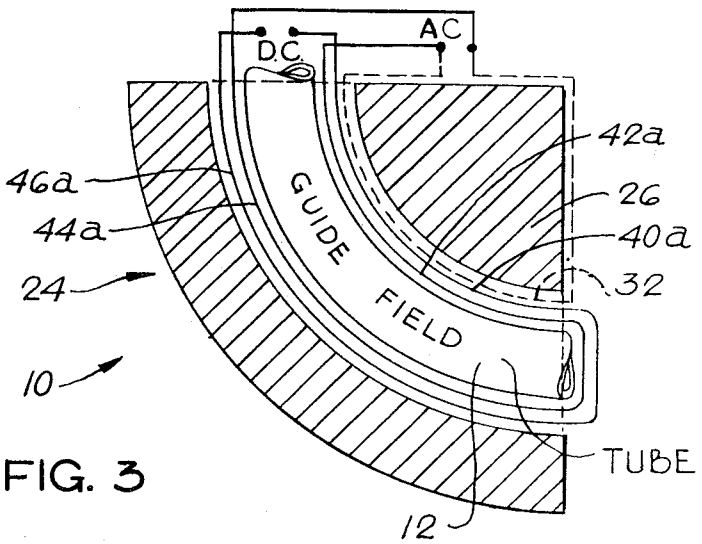
FIG. 3 is a fragmentary diagrammatic cross section, taken generally along the line 3—3 in FIG. 1.

FIG. 3 is a cross sectional view which shows only one quadrant of the betatron accelerator 10, for convenience of illustration. It will be understood that the betatron 10 actually extends around a complete circle. In some cases, the magnetic yoke 24 may actually be made in sectors.

Figure 4:
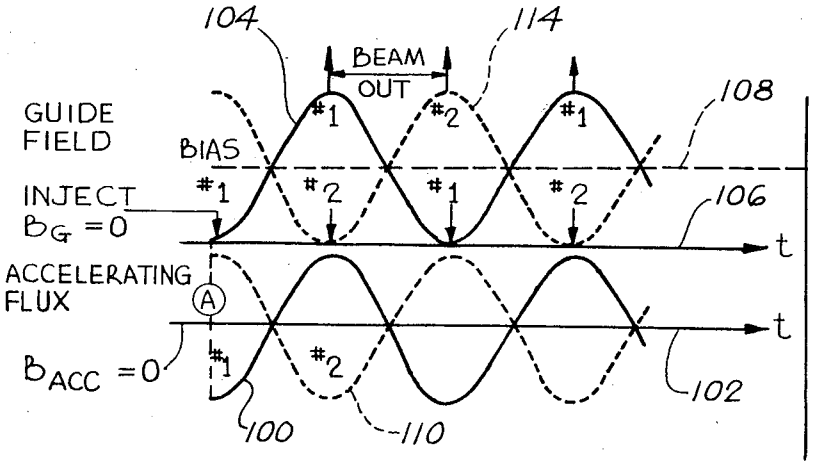
FIG. 4 is a waveform diagram illustrating the operation of the betatron accelerator.

FIG. 4 is a waveform diagram, illustrating the operation of the betatron accelerator 10 of FIGS. 1–3. FIG. 4 includes a sine wave graph 100 representing the accelerating flux, produced by the alternating current in the flux coils 32. The zero level for the accelerating flux is indicated at 102. The electron beam in the first betatron tube 12 is accelerated when the accelerating flux is changing between its negative maximum and its positive maximum. This is the first half cycle of the sine wave graph 100, which starts with its negative maximum value in FIG. 4.

It will be seen that FIG. 4 also includes a sine wave graph 104, representing the guide field for the electron beam 16 in the first betatron tube 12. The zero level for the guide field is indicated by the line 106. The direct current biasing level is indicated by the broken line 108. Due to the biasing action, the negative maximum of the guide flux is shifted upwardly so that it is substantially at or near the zero level 106.

As indicated by the INJECT legend and arrows in FIG. 4, the electrons or other charged particles are injected into the first betatron tube 12 when the guide field 104 is just a small amount above the zero level 106. The energy of the injected electrons is at a low level, consistent with the low level of the guide field at the time of injection. The accelerated electron beam is extracted from the first betatron tube 12 at or near the positive peak of the guide field 104. Such positive peak coincides in time with the positive peak of the accelerating flux field 100. The extraction times are indicated by the arrows and the legend BEAM OUT in FIG. 4.

In the second betatron tube 14, the electrons are injected in the opposite direction of rotation, during the next half cycle of the accelerating flux, when the accelerating flux is changing between its positive maximum and its negative maximum. For convenient illustration, the accelerating flux is indicated by the inverted sine wave graph 110, shown in broken lines in FIG. 4. The guide field for the second betatron tube 14 is represented by the inverted sine wave graph 114. These sine waves are inverted, because the direct current bias for the second betatron tube 14 is in the opposite direction, relative to the bias for the first betatron tube 12. A more compact illustration results from inverting the flux and guide field sine waves 110 and 114.

As indicated by the INJECT legend and arrows in FIG. 4, the electron beam for the second betatron tube 14 is injected when the guide field 114 for the second betatron tube is just a small negative amount above the zero level 106. The energy of the injected electrons is consistent with the small guide field at the injection time. The electrons are accelerated in the opposite direction of rotation by the changing accelerating flux field 110 which goes from its positive peak to its negative peak, whereupon the second electron beam is extracted and directed against the second target 94.

Thus, two electron beams are accelerated by the push-pull betatron 10 during each complete cycle of the alternating current flux field, one beam in the first betatron tube 12 and the other beam in the second betatron tube 14. The two betatron beams 16 and 18 are accelerated in opposite directions of rotation in the first and second tubes 12 and 14. The full advantages of direct current biasing of the guide field are realized, in that each betatron beam is accelerated by substantially the full change in the alternating accelerating flux between its opposite peaks. Thus, the energy levels of the extracted electron beams are maximized.

Figure 5:
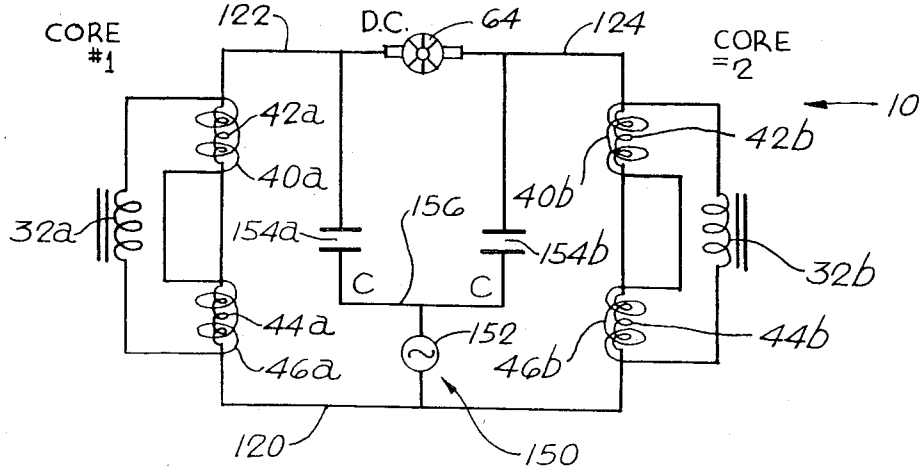
FIG. 5 is a schematic circuit diagram illustrating a modified electrical circuit for the betatron accelerator.

FIG. 5 is a schematic circuit diagram showing a modified circuit for the betatron accelerator 10 of FIGS. 1–4. In the circuit of FIG. 5, the guide field coils 42*a*, 44*a*, 42*b* and 44*b* are supplied with both alternating current and direct current energization, instead of using separate coils for alternating current and direct current, as in the circuit of FIG. 2. In the circuit of FIG. 5, the guide field coils 42*a* and 44*a* for the first betatron tube 12 are connected in series, as before. Likewise, the guide field coils 42*b* and 44*b* for the second betatron tube 14 are connected in series. The direct current generator 64 is connected in a series circuit which includes all of the coils 42*a*, 44*a*, 44*b* and 42*b*. This series circuit includes a conductor 120 which is connected between one end of each of the coils 44*a* and 44*b*. The opposite ends of the coils 42*a* and 42*b* are connected together by a conductor 122, the generator 64 and a conductor 124. The conductors 122 and 124 are connected to the opposite terminals of the direct current generator 64. In this series circuit, the direct current energization is oppositely polarized in the first and second sets of guide field coils. Thus, the direct current is polarized in one direction in the coils 42*a* and 44*a*, and in the opposite direction in the coils 42*b* and 44*b*.

In FIG. 5, the guide field coils 42*a*, 44*a*, 42*b* and 44*b* are effectively energized in parallel by alternating current source means 150. Both sets of coils have the same polarization, so that the alternating current components of the guide fields for both betatron tubes 12 and 14 are in phase and in the same direction. As shown in FIG. 5, the alternating current source means 150 may comprise an alternating current source or generator 152 and two capacitances 154*a* and 154*b*, each of which may actually comprise a bank of capacitors. The AC source 152 is connected between the conductor 120 and a conductor 156 which is connected to one side of both of the capacitances 154*a* and 154*b*. The other side of the capacitance 154*a* is connected to the conductor 122 which extends between one side of the DC generator 64 and the upper end of the guide field coil 42*a*. The other side of the other capacitance 154*b* is connected to the conductor 124 which extends between the opposite side of the DC generator 64 and the upper end of the guide field coil 42*b*. The capacitances 154*a* and 154*b* establish resonant conditions with the two sets of guide field coils. One set comprises the coils 42*a* and 44*a*, while the other set comprises the coils 42*b* and 44*b*.

In the circuit of FIG. 5, the DC from the generator 64 does not flow through the AC source 152, because the capacitances 154*a* and 154*b* prevent any such flow. Thus, the AC source 154 is isolated from the DC flow. Moreover, the DC source 64 is substantially isolated from the AC flow, so that no substantial AC flows through the DC source 64. This isolation is achieved without any need to provide a large choke coil, as in certain past betatron accelerators. Because of the balanced arrangement of the AC source 152 and the capacitances 154*a* and 154*b*, the opposite sides of the DC generator 64 are supplied with substantially the same AC voltage, so that there is no substantial AC voltage difference across the DC generator 64. The circuit of FIG. 5 may be regarded as a balanced bridge circuit, as to the AC energization. The DC generator 64 is in a bridging position between balanced points along the two legs of the bridge circuit. It can also be said that the two sets of guide field coils for the two betatron tubes 12 and 14 act as choke coils for each other. Perfect balance may not always be achieved, in which case a small choke coil may be placed in series with the DC source 64, or some provision may be made for adjusting the balance.

In the circuit of FIG. 5, the alternating current flux coils 32*a* and 32*b* are energized with alternating current by coils which are inductively coupled to the guide field coils 42*a*, 44*a*, 42*b* and 44*b*. In this way, no DC flows through the flux coils 32*a* and 32*b*. The inductive energization may be provided by the coils 40*a*, 46*a*, 40*b* and 46*b* of the betatron 10. These are the same coils which are employed to carry DC in the circuit diagram of FIG. 2. The coupled coils act as transformer means. Thus, in the circuit of FIG. 5, the accelerating flux coil 32*a* is connected across and is energized by the series combination of the field coils 40*a* and 46*a* for the first betatron tube 12. Similarly, the accelerating flux coil 32*b* is connected across and is energized by the series combination of the field coils 40*b* and 46*b*. In the circuit of FIG. 5, the number of turns of the various flux and field coils may be varied to achieve the required relationship between the accelerating flux and the guide field, so as to provide the desired acceleration of the electrons, while also maintaining the electrons in stable orbits of the desired radius. If desired, the flux coils 32*a* and 32*b* may be energized by separate transformer means, connected between the AC source means 150 and the coils 32*a* and 32*b*, instead of using coupled coils on the betatron.

FIGS. 8 and 9 illustrate a modified betatron accelerator 130 which employs only one betatron tube, such as the tube 12, having an accelerating flux coil 32 and guide field coils 42*a* and 44*a*. Beams of electrons or other charged particles are alternately accelerated in opposite directions of rotation in the betatron tube 12. The betatron 130 employs the AC source means 50, comprising the AC source 52 in series with the resonating capacitance 54, connected in a series circuit across the series connected guide field coils 42*a* and 44*a*. The betatron 130 is also provided with oppositely polarized DC sources 132 and 134. The accelerating flux coil 32 of FIG. 8 is sequentially energized with AC from the AC source means 50, and with direct current of opposite polarities from the DC sources 132 and 134. This is accomplished by providing three heavy duty, fast acting switching devices 140-1, 140-2, and 140-3. These switches are referred to in FIG. 9 by the numbers 1, 2 and 3. The switching devices may utilize heavy duty electronic switching means, such as ignitrons, for example, under the control of a switching control unit 142. The switching devices 140-1, 140-2 and 140-3 and the associated circuits may be referred to as power crowbar circuits, because of the magnitude of the currents which are switched. As shown, the switching device 140-1 is adapted to connect the DC source 132 across the accelerating flux coil 32. The switching device 140-2 is adapted to connect the AC source means 50 across the flux coil 32. The switching device 140-3 is adapted to connect the oppositely polarized DC source 134 across the flux coil 32. All of this is done in proper sequence by the switching control unit 142, at the appropriate times in relation to the alternating current energizing cycle for the guide field coils 42*a* and 44*a*.

FIG. 9 comprises waveform diagrams illustrating the operation of the betatron 130 of FIG. 8. It will be seen that FIG. 9 comprises a sine wave graph 150, representing the alternating current guide field for the betatron 130, as produced by the guide field coils 42*a* and 44*a*. FIG. 9 also comprises a pulsed waveform 152, representing the accelerating flux, as produced by pulsing the core flux coil 32 with alternating and direct energization by sequentially operating the switching devices 140-1, 140-2 and 140-3.

As shown by the legends in FIG. 9, the first electron beam is accelerated in one direction of rotation in the betatron tube 12 during approximately the first 90° of the guide field waveform 150. During this interval, the guide field increases from 0 to its positive maximum, along a substantially sine wave curve. For this portion of the cycle, the switching device 140-2 is closed, while the switching devices 140-1 and 140-3 are open, so that the core flux coil 32 is supplied with energization from the alternating current source means 50. The degree of energization is sufficiently great so that the accelerating flux rises rapidly from its negative maximum value 154 to its positive maximum value 156. The first electron beam is then extracted and directed against the target 90.

During the second 90° interval of the guide field 150, the core flux 152 is clamped at its positive maximum value 156 by closing the switching device 140-1, while opening the switching devices 140-2 and 140-3.

During the third 90° interval of the guide flux 150, the second electron beam is accelerated in the betatron tube 12 in the opposite direction of rotation. During this interval, the guide field 150 changes from 0 to its negative maximum value, along the sine wave curve. The core flux 152 changes rapidly between its positive maximum value 156 and its negative maximum value 154. This is accomplished by closing the switching device 140-2 while opening the switching devices 140-1 and 140-3.

During approximately the fourth 90° interval of the guide field 150, the core flux 152 is clamped at its negative maximum value 154 by closing the DC switching device 140-3 while opening the switching devices 140-1 and 140-2. This completes the cycle of the guide field 150 which is then repeated as long as the betatron 130 is operated. It will be understood that the second electron beam is extracted and targeted when the core flux 152 reaches its negative maximum value.

The betatron 130 of FIGS. 8 and 9 may employ two injectors for injecting the first and second electron beams into the betatron tube 12 in different directions of rotation. The injectors may be similar to the injectors 80 and 82 of FIGS. 6 and 7, but in the same betatron tube 12. The first electron beam is injected near the beginning of the first 90° of the guide field waveform 150. The second electron beam may be injected near the beginning of the third 90°.

The betatron 130 employs extracting means, similar to the extractors 88 and 92 of FIGS. 6 and 7, for extracting the two electron beams and causing them to strike targets, similar to the targets 90 and 94 of FIGS. 6 and 7, but in the same betatron tube 12.

The betatron 130 of FIGS. 8 and 9 has the advantage of requiring only one betatron accelerating tube 12. However, the betatron 130 requires switching devices having very high current handling capacity and ability to operate very rapidly.

Certain additional comparisons are of interest between the push-pull betatron 10 of FIGS. 1–4 and the full-wave clamped or switched betatron 130 of FIGS. 8 and 9. The full-wave clamped betatron 130 requires greater energy storage in the capacitance bank, by a factor of two, so that the cost of the capacitance bank for the full-wave clamped betatron 130 is greater than in the case of the push-pull betatron 10 of FIGS. 1–4. However, due to the fact that the push-pull betatron 10 employs two betatron tubes, while the full-wave clamped betatron 130 employs only one betatron tube, the push-pull betatron 10 requires a greater weight of iron in the magnetic circuit, by a factor of about 1.5. In other words, the push-pull betatron 10 requires about 50% more iron.

The push-pull betatron 10 does not require the fast acting heavy duty switching devices which are required for the full-wave clamped betatron 130.

The push-pull betatron 10 of FIGS. 1–7 compares favorably with a conventional full-wave betatron, in which a first electron beam is circulated in one direction during the first half cycle, while a second electron beam is circulated in the opposite direction during the second half cycle. The conventional full-wave betatron does not employ DC field or flux biasing. Because of the advantages of DC field biasing, the push-pull betatron requires only one half the energy storage capacity in the capacitance bank, compared with the conventional full-wave betatron. Thus, the cost of the capacitance bank for the push-pull betatron is less than in the case of the full-wave betatron. Moreover, the push-pull betatron requires substantially less iron in the magnetic circuit. The weight of the iron for the push-pull betatron is only about two-thirds the weight of the iron for a comparable full-wave betatron. Thus, the cost of the iron for the push-pull betatron is less than in the case of the conventional full-wave betatron.

The stored AC energy of the push-pull betatron is less than in the conventional full-wave betatron because one-half the field current in the push-pull betatron is supplied by DC. The iron weight of a conventional betatron is greater than the iron weight of a push-pull betatron because the core flux density of the conventional betatron only swings from zero to its maximum during acceleration, while in the push-pull betatron, the core flux density changes between its negative maximum and its positive maximum.

The elimination of any need for a large choke coil is an important advantage of the push-pull betatron. Choke coils have been required in certain conventional betatrons utilizing DC field biasing. The choke coil must carry the full DC, which is of a magnitude equal to the AC field current, for full field biasing. The inductance of the choke coil is generally greater than the inductance of the field coil for the betatron. Because of the large inductance of the choke coil and the large DC carried by the choke coil, the cost and weight of the choke coil are comparable with and often even greater than the cost and weight of the field coil and magnetic circuit for the conventional betatron itself. Thus, the elimination of the need for a large choke coil is an important advantage of the push-pull betatron pair.

A modified betatron pair may be provided, representing a reversal of certain conditions, relative to the push-pull betatron 10. Such modified betatron has two betatron tubes, in which two electron beams are accelerated. However, the polarization of the AC accelerating flux and the AC guide field component is reversed for the second tube, while the polarization of the DC field bias is made the same for both tubes. The electron beams are injected alternately but in the same direction in both tubes. With a larger magnetic circuit, this modification can be achieved with the two tubes coaxial. However, it is preferable to provide a magnetic circuit having two main legs in which the accelerating flux is in opposite directions, and to mount the two betatron tubes around the two legs. The guide field coils are appropriately relocated.

Another modification is to employ the energizing circuit of FIG. 5 for two separate conventional field biased betatrons, in which each betatron acts as the choke coil for the other betatron. The flux coil 32*a* and the field coils 42*a* and 44*a* represent the first betatron. The flux coil 32*b* and the field coils 42*b* and 44*b* represent the second betatron. The flux coils 32*a* and 32*b* are energized by transformer means, either separate from the betatrons or utilizing extra coupling coils on the betatrons, such as the coupling coils 40*a*, 46*a*, 40*b* and 46*b*.

What is claimed is:

1. A betatron accelerator, comprising an annular betatron tube having a vacuum chamber therein in which charged particles are to be accelerated, a magnetic circuit including an axial magnetic core along the axis of said tube, accelerating flux producing means for producing a changing accelerating flux in said core and linking with said tube for producing acceleration of charged particles in said tube, alternating current guide field producing means for producing an alternating current guide field through said tube for guiding the charged particles along generally circular orbits in said tube, an alternating current source for energizing said guide field producing means, first and second oppositely polarized direct current sources, switching means including an AC switching device for connecting said alternating current source to said accelerating flux producing means, a first DC switching device for connecting said first direct current source to said accelerating flux producing means, a second DC switching device for connecting said second oppositely polarized direct current source to said accelerating flux producing means, and control means for closing said AC switching device during approximately the first 90° of the guide field cycle, said control means closing said first DC switching device while opening said AC switching device and said second DC switching device during approximately the second 90° of said cycle to clamp the accelerating flux at its positive maximum value, said control means closing said AC switching device while opening both of said DC switching devices during approximately the third 90° of said cycle for rapidly changing the accelerating flux between its positive and negative maximum values, said control means closing said second DC switching device while opening said AC switching device and said first DC switching device during approximately the fourth 90° of said cycle to clamp the accelerating flux at its negative maximum value, and means for injecting a first electron beam for acceleration in one direction of rotation during said first 90° while injecting a second electron beam for acceleration in the opposite direction of rotation during said third 90° .

2. A betatron accelerator according to claim 1, said alternating current source including an alternating current generator and a resonating capacitance.

3. A betatron accelerator according to claim 1, said AC switching device and said first and second DC switching devices being fast acting switching devices of high current handling ability.

4. A betatron accelerator according to claim 1, said AC switching device and said first and second DC switching devices being fast acting electronic switching devices of high current handling ability.

5. An accelerator according to claim 1, said accelerating flux producing means comprising accelerating flux producing coil means, and inductively coupled means for energizing said guide field producing coil means with alternating current substantially in phase with the alternating current energization of said guide field producing coil means.

6. An accelerator according to claim 5, said inductively coupled means comprising transformer means.

* * * * *